US011332947B2

(12) United States Patent
Hayman et al.

(10) Patent No.: US 11,332,947 B2
(45) Date of Patent: May 17, 2022

(54) INTERMEDIATE SCAFFOLD JOINT

(71) Applicants: Yates Westley Hayman, Walker, LA (US); Johnny Curtis, Denham Springs, LA (US)

(72) Inventors: Yates Westley Hayman, Walker, LA (US); Johnny Curtis, Denham Springs, LA (US)

(73) Assignee: Deltak Manufacturing, Inc., Walker, LA (US)

( * ) Notice: Subject to any disclaimer, the term of this patent is extended or adjusted under 35 U.S.C. 154(b) by 948 days.

(21) Appl. No.: 15/925,283

(22) Filed: Mar. 19, 2018

(65) Prior Publication Data

US 2018/0274249 A1 Sep. 27, 2018

Related U.S. Application Data

(60) Provisional application No. 62/475,346, filed on Mar. 23, 2017.

(51) Int. Cl.

| | |
|---|---|
| ***E04G 7/30*** | (2006.01) |
| ***E04G 7/08*** | (2006.01) |
| ***E04G 7/22*** | (2006.01) |
| ***E04G 5/06*** | (2006.01) |

(52) U.S. Cl.

CPC ..... *E04G 7/308* (2013.01); *E04G 7/08* (2013.01); *E04G 7/22* (2013.01); *E04G 5/061* (2013.01)

(58) Field of Classification Search

CPC .... E04G 7/00; E04G 7/02; E04G 7/06; E04G 7/08; E04G 7/22; E04G 7/24; E04G 5/061; F16B 2/06; F16B 2/12; F16B 7/22; Y10T 403/30

See application file for complete search history.

(56) References Cited

U.S. PATENT DOCUMENTS 3,179,212 A * 4/1965 Gostling ..... E04G 7/307 52/646
4,273,463 A * 6/1981 Dobersch ..... F16B 7/22 403/246
4,445,307 A * 5/1984 Puccinelli ..... E04G 7/307 52/638
4,632,222 A * 12/1986 Chen ..... E04G 5/06 182/186.6
4,840,513 A * 6/1989 Hackett ..... E04G 7/307 403/49
5,028,164 A * 7/1991 Williams ..... E04G 7/308 403/246
5,078,532 A * 1/1992 Williams ..... F16B 7/22 403/246

(Continued)

FOREIGN PATENT DOCUMENTS

WO WO-2011094351 A2 * 8/2011 ..... E04G 7/02

*Primary Examiner* — Jonathan P Masinick
(74) *Attorney, Agent, or Firm* — Intellectual Property Consulting, LLC; Bernard F. Meroney

(57) ABSTRACT

An improved intermediate scaffold joint comprising a frame, a first mounting member, a second mounting member, and a vertical stub. The frame has an interior side, an exterior side, and a top side. A lock member is slidable in the interior of the frame. The frame has a rear plate portion that has two openings to accommodate the engagement portions of a horizontal scaffold join, but lacks ½ annular cups.

15 Claims, 17 Drawing Sheets

(56) References Cited

U.S. PATENT DOCUMENTS

| | | | | | |
|---|---|---|---|---|---|
| 5,605,204 | A * | 2/1997 | Ausejo | E04G 7/307 | 182/186.7 |
| 5,961,240 | A * | 10/1999 | Bobrovniczky | E04G 7/32 | 403/49 |
| 6,027,276 | A * | 2/2000 | Schworer | F16B 7/22 | 403/49 |
| 6,405,830 | B1 * | 6/2002 | Hayman | E04G 5/14 | 182/113 |
| 6,415,891 | B1 * | 7/2002 | Hayman | E04F 11/00 | 182/178.1 |
| 6,932,195 | B1 * | 8/2005 | Hayman | F16B 7/0493 | 182/178.1 |
| 8,973,711 | B2 * | 3/2015 | Hayman | E04G 7/304 | 182/186.8 |
| 9,303,417 | B2 * | 4/2016 | Hayman | E04G 7/307 | |
| 9,347,230 | B1 * | 5/2016 | Hayman | E04G 1/152 | |
| 2014/0020982 | A1 * | 1/2014 | Hayman | E04G 7/32 | 182/223 |
| 2019/0330864 | A1 * | 10/2019 | Curtis | E04G 7/307 | |

* cited by examiner

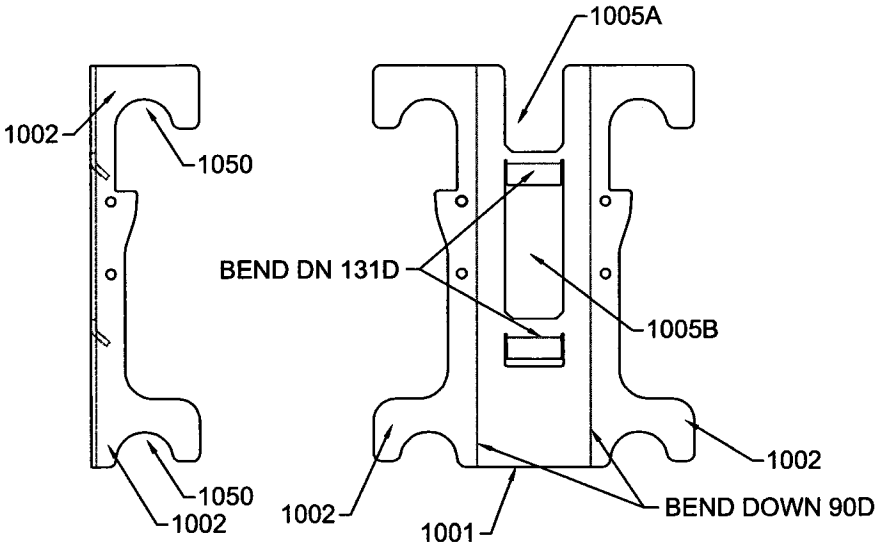
FIG. 7D
FIG. 7C
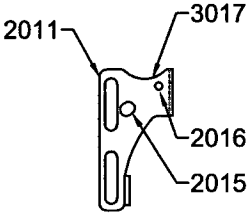
FIG. 7E
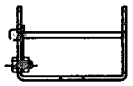
FIG. 7F
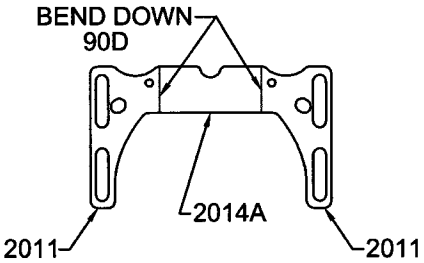
FIG. 7G
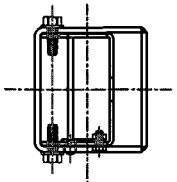
FIG. 7B
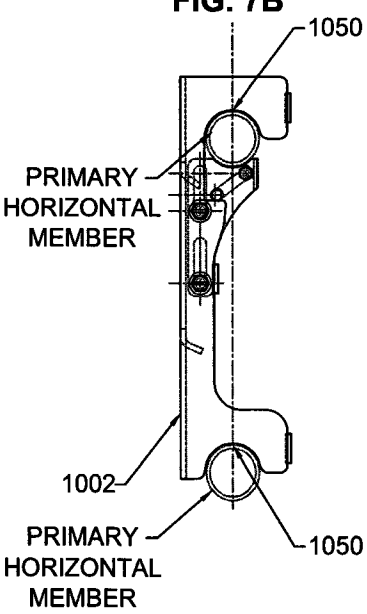
FIG. 7A

INTERMEDIATE SCAFFOLD JOINT

I. CROSS-REFERENCE TO RELATED APPLICATION

This application claims the priority benefit of U.S. Provisional application No. 62/475,346 filed on Mar. 23, 2017, which is hereby incorporated by reference.

II. BACKGROUND

Scaffolds are temporary structures composed of vertical and horizontal members joined together to create a frame, which usually has an elevated working surface or decking. Generally, a scaffold frame comprises a series of joined vertical members that extend in an unbroken string until a desired work surface elevation is reached, generally positioned well above the ground. Horizontal members are used to couple adjacent vertical members to stabilize the structure, but also are used to form work surface support or frame at desired elevations.

There are instances where it is desirable to attach intermediate scaffold members to the scaffold structure. An intermediate scaffold member is one which is not directly attached to a primary vertical member (e.g., a vertical member which extends solely or in combination with other vertical scaffold members to ground level). For instance, an access safety railing located at the working surface may need intermediate vertical members to properly define the railing. Additionally, there may be instances where it is desirable to attach an intermediate horizontal member to an existing horizontal member, such as for additional load support for a deck or to accommodate an opening in a scaffold deck. These "intermediate scaffold members" are attached to the scaffold structure with an intermediate scaffold joint. Intermediate scaffold joints are typically attached to a primary horizontal scaffold member (i.e., an existing horizontal member that extends between two vertical scaffold members). The intermediate scaffold joint can be adapted to couple to an intermediate horizontal member, an intermediate vertical member, or both.

One prior art intermediate scaffold joint is shown in FIG. 1. This prior art joint 40 features two protrusions 500 which are engaged by a latch mechanism 44 attached to the end of the intermediate horizontal member 52. To install an intermediate vertical member 45 to the joint shown in FIG. 1, the intermediate horizontal member 52 must first be attached to the joint 40 to prevent the joint 40 from rotating about horizontal scaffold member 49. The device described in U.S. Pat. No. 6,932,195 (hereby incorporated by reference) functions in a similar manner, except that the latch mechanism has been replaced with a clamp, thereby providing an intermediate scaffold joint with universal applicability.

A second version of an intermediate scaffold joint is shown in FIG. 2, and is described in U.S. Pat. No. 8,973,711 (hereby incorporated by reference). In this version, a pivoting clamp member 200 is used to lock the intermediate scaffold joint 110 onto a tubular horizontal member 600. As shown in FIG. 3, the rear of these prior art intermediate scaffold joints (ISJ) have two partial upstanding cups 500 welded to the rear face or interior facing portion of the ISJ. These partial cups are designed to accommodate a horizontal scaffold end connector (which is located at a terminating end of a horizontal member) that includes two engagement sections designed to engage with cups. (See FIG. 1). While the ISJ described in the U.S. Pat. Nos. 8,973,711 and 6,932,195 references both included partial cups on the rear side of the ISJ that have to be attached by welding. This is a labor intensive process, and the pivoting latch mechanism in the U.S. Pat. No. 8,973,711 is complex to manufacture and assemble. A simpler ISJ is needed.

Therefore, it is an object of this invention to provide an improved intermediate scaffold joint which is easier to assemble and use, and which preferably lacks cups or half cups.

III. SUMMARY

An improved intermediate scaffold joint having features of the present invention comprises, in a first embodiment, a frame, a first mounting member, and a second mounting member. The frame has an interior side, an exterior side, a top side and bottom side. Both the first mounting member and the second mounting member are attachable to horizontal members in an existing scaffold structure frame, between two existing vertical members of the scaffold structure. A vertical stub may be attached to the frame's top side for attaching an intermediate vertical scaffold member to the frame. The rear side of the frame is adapted to couple to a horizontal scaffold member join that preferably has an upper and a lower engagement section (such as a hook portion or a tooth portion).

In an embodiment of the present invention, the intermediate scaffold joint can also include a sliding lock member on the front or exterior side of the ISJ to clamp or lock the ISJ to a horizontal scaffold member in the existing scaffold frame. The sliding lock member effectively traps the joined top horizontal scaffold member, thereby locking the intermediate scaffold joint to the scaffold structure. The rear or interior facing portion of the improved ISJ preferably does not include partial cups, but instead, simply has two cutout sections through the body or frame onto which a horizontal scaffold member can attach.

IV. BRIEF DESCRIPTION OF THE DRAWINGS

FIG. 7A is a side ghosted view of the ISJ of FIG. 6A.

FIG. 7B is a top view of the ISJ of FIG. 6A.

FIG. 7C is a side elevation view of the frame of the ISJ of FIG. 6A.

FIG. 7D is a top elevation view of a stamped piece of metal to be bent into the frame of the ISJ of FIG. 6A.

FIG. 7E is a side elevation of the lock member of the ISJ of FIG. 6A.

FIG. 7F is a top elevation view of the lock member of the ISJ of FIG. 6A.

FIG. 7G is a top elevation view of a stamped piece of metal to be bent into the lock member of FIG. 6A.

V. DESCRIPTION

Figure 1:
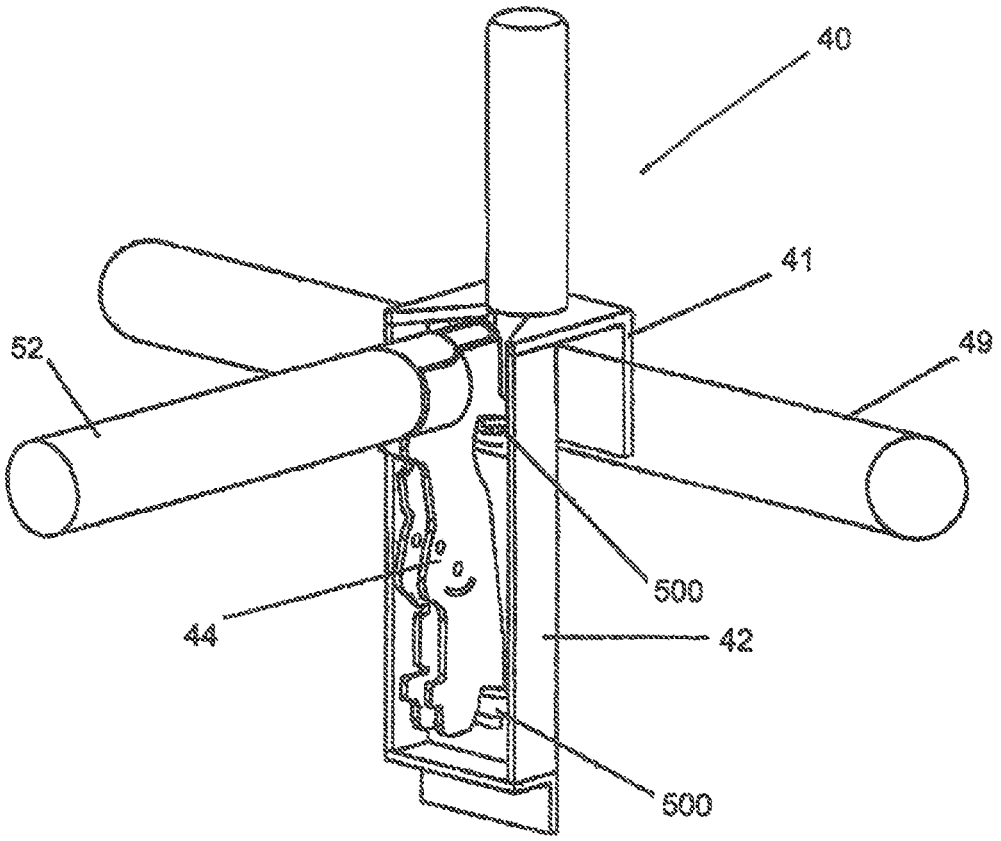
FIG. 1 Prior Art
FIG. 1 depicts a perspective rear view of a prior art intermediate scaffold joint.
Figure 4:
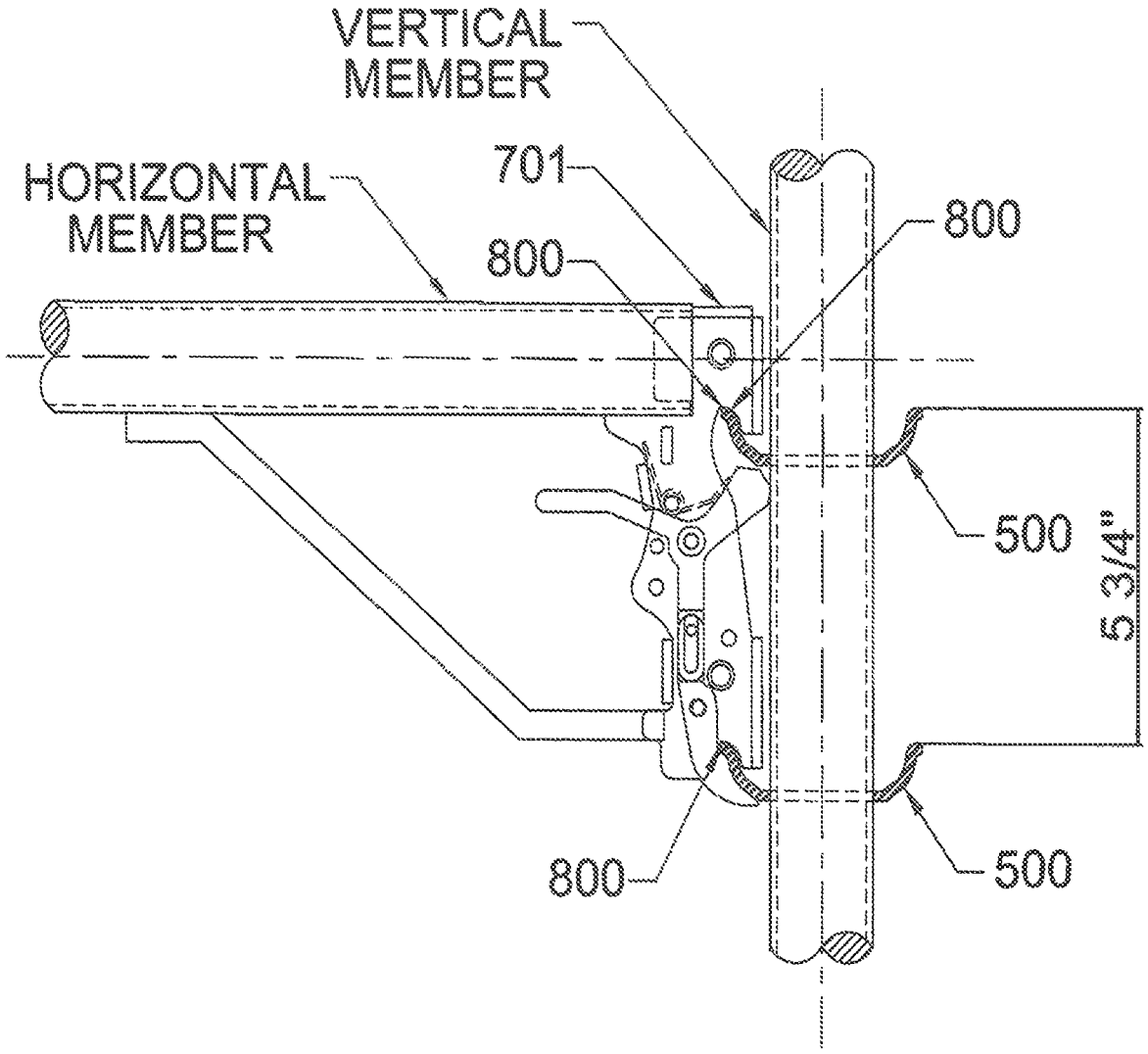
FIG. 4 Prior Art
FIG. 4 is a side ghosted view of a prior art horizontal scaffold member end connector join (Excel type).

FIG. 1 depicts a prior art intermediate scaffold joint 40 designed to work in scaffold systems where the horizontal scaffold members 52 terminate with a join that has two engagement portions (an upper and a lower engagement section, as shown in FIG. 4, hook portions 800) adapted to couple to an upstanding cup 500, such as disclosed in U.S. Pat. Nos. 5,028,164, 5,078,532, and 6,932,195, each of which are incorporated herein by reference (the "Excel Latch Mechanism"), or to couple to a similar horizontal scaffold join shown in U.S. Pat. No. 4,445,307 (a "Safway type join") (hereby incorporated by reference). The intermediate scaffold joint 40 features a bracket 41 attached to a frame 42. The bracket 41 and frame 42 form a three-sided channel structure which is adapted or shaped to receive a horizontal scaffold member 49. In operation, the joint's bracket 41 is placed over the horizontal scaffold member 49 (the primary horizontal scaffold members). In this arrangement, the primary horizontal scaffold member 49 will be positioned within the channel structure. An intermediate horizontal scaffold member 52 (at 90 degrees to the primary horizontal scaffold member 49) is then coupled onto the joint's two protruding ½ cup members 43 via the two engagement sections. The intermediate horizontal scaffold member 52 is latched or locked to ISJ 40 to prevent the joint 40 from rotating about the horizontal scaffold member 49. An intermediate vertical scaffold member can then be mounted to the vertical stub 45. A pin 46 can be used to secure the intermediate vertical scaffold member to the joint's vertical stub 45.

Figure 2:
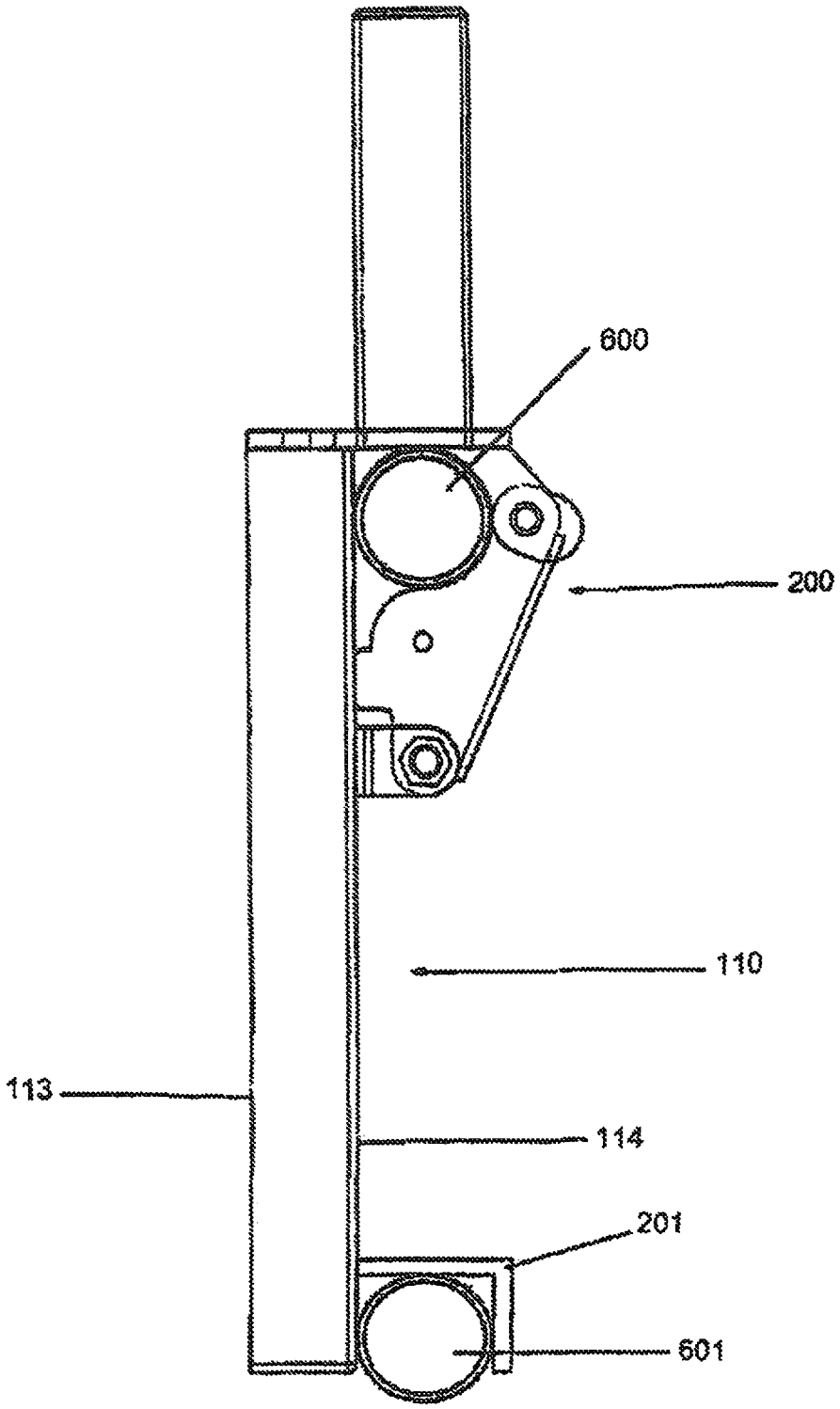
FIG. 2 Prior Art
FIG. 2 depicts a perspective side view of another prior art intermediate scaffold joint.
Figure 3:
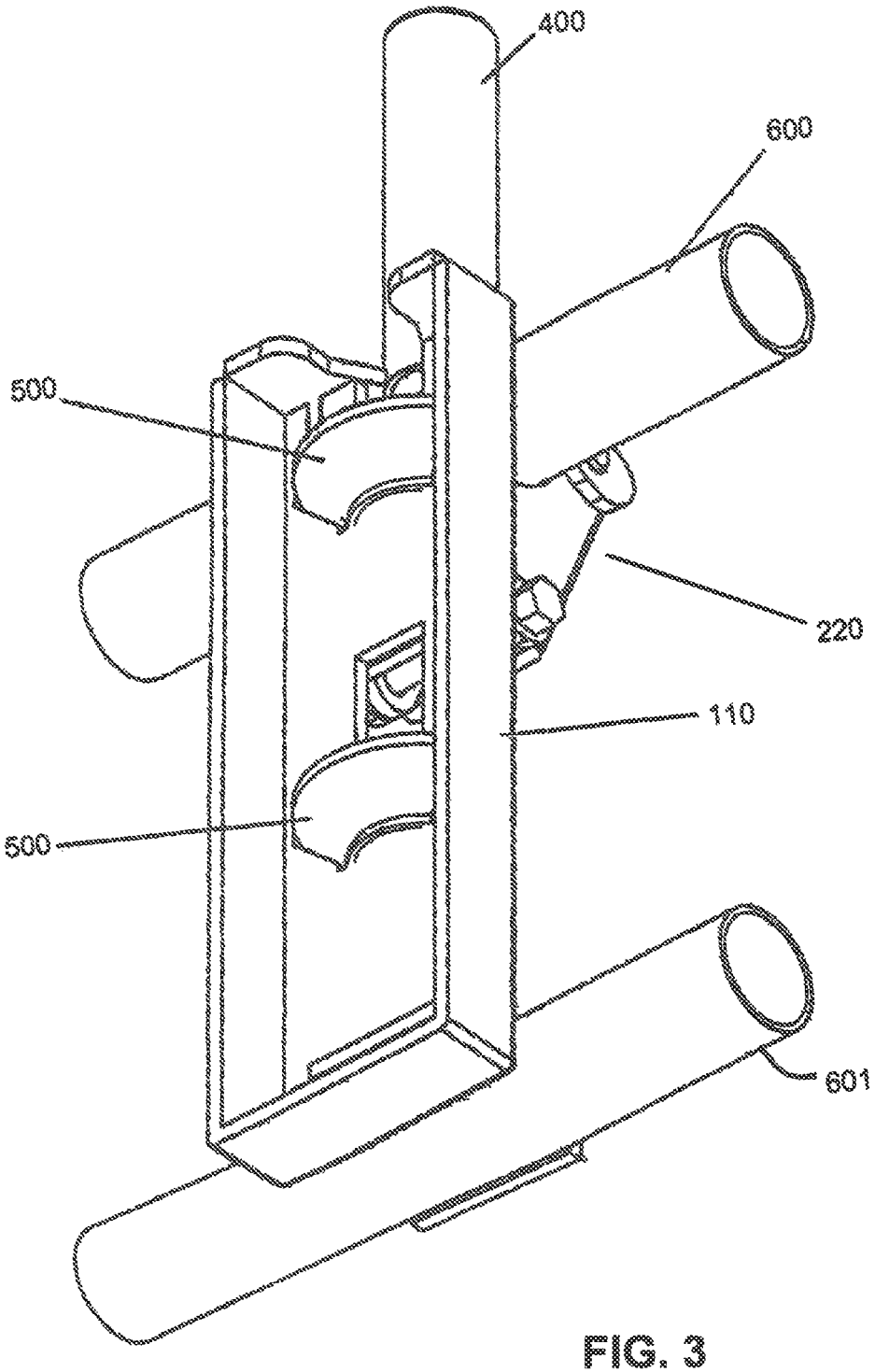
FIG. 3 Prior Art
FIG. 3 depicts a perspective rear view of the intermediate scaffold joint of FIG. 2.

A second prior art intermediate scaffold joint 100 is depicted in FIG. 2. As shown in FIG. 2, the frame 110 has an interior or rear side 113, an exterior or front side 114, and a top side 115. A first mounting member 200 is attached to the frame's exterior side 114 at a first position for securing the frame to a first primary horizontal scaffold member 600. A second mounting member 201 is attached to the frame's exterior side 114 at a second position spaced apart vertically from the first position for securing the frame to a second primary horizontal scaffold member 601.

Figure 5:
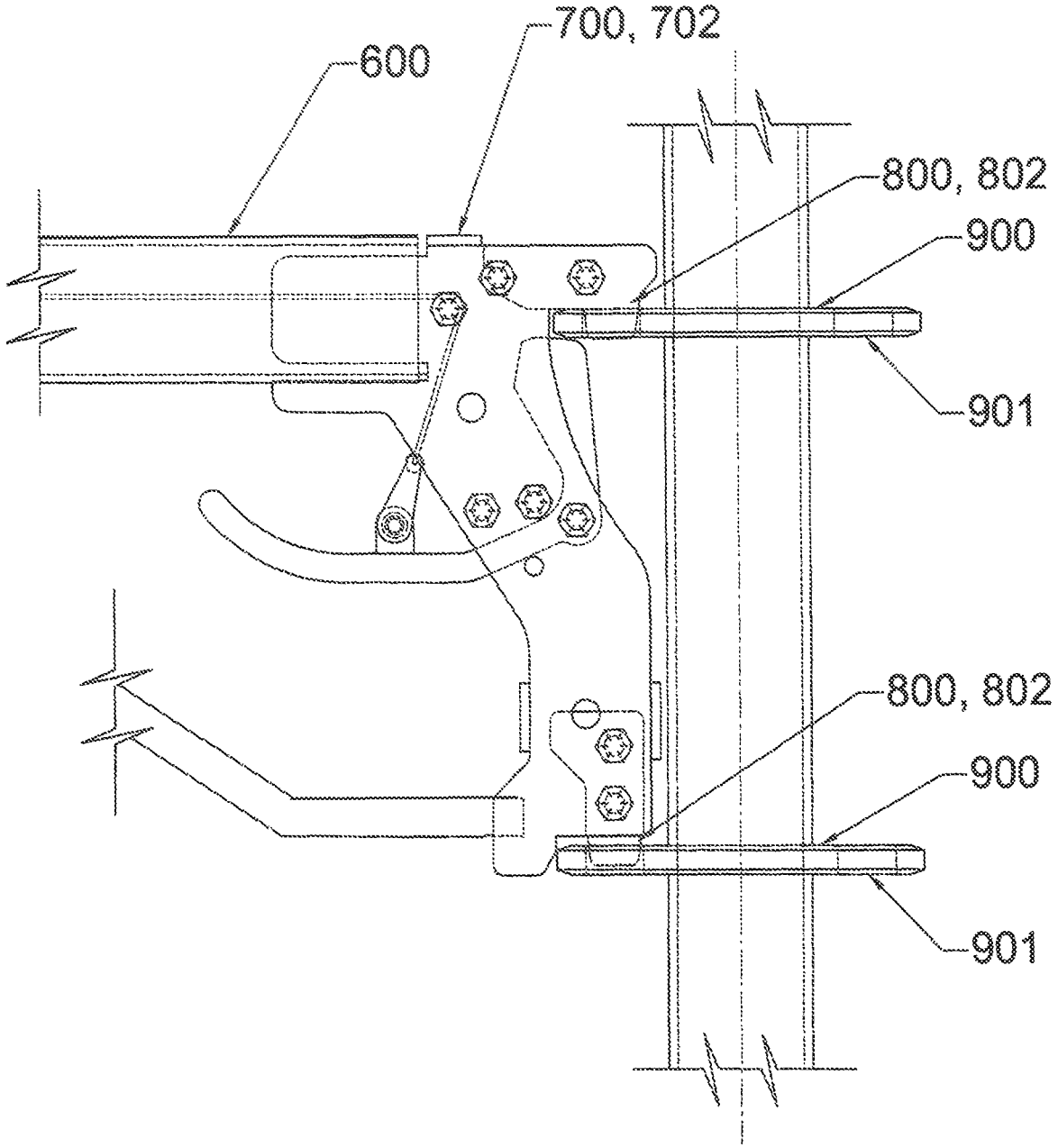
FIG. 5 Prior Art
FIG. 5 is a side elevation ghosted view of a prior art horizontal scaffold end connector join (Next Generation type).

The first mounting member 200 includes a pivoting latch 220. The latch 220 functions to secure the intermediate scaffold joint 100 to the first primary horizontal scaffold member 900. In the embodiment shown in FIG. 2, the second mounting member 201 is a channel bracket 240. The channel bracket 240 functions to secure the intermediate scaffold joint 100 to a second primary horizontal scaffold member 901. The intermediate scaffold joint 100 of these prior art devices contains one or more projections 500 (i.e., partial cups) extending from the frame's interior side 113, as shown, the projections 500 are the ½ cup members or rings described in U.S. Pat. Nos. 5,028,164, 5,078,532, and 9,347,230. These ½ cup members can engage with a horizontal scaffold member 600, where the horizontal scaffold member terminates in an end connector join 700 having two spaced apart engagement portions 800 for attaching to a cup on a vertical scaffold member. One type of end connector join is an Excel Latch Mechanism described in U.S. Pat. Nos. 5,028,164, 5,078,532, 9,303,417 and 9,347,230, incorporated by reference (one embodiment of an Excel type end connector is shown in FIG. 4 as reference 701, where the two engagement portions are hook like engagement portions 800) separated by a vertical distance D or the Safway join (described in U.S. Pat. No. 4,445,307) also having engagement portions separated by a vertical distance, and used to engage and couple to intermediate scaffold member to the joint 100. The projections may also be protruding ½ annular rings such as for the Excel or Safway type end connectors, or rosettes having a series of openings for interfacing with a wedge or pin-lock type of join, such as shown in in U.S. Pat. Nos. 4,273,463 or 6,027,276; 5,961,240; 5,605,204; 4,840,513; and PCT publication number WO 2011/094351 (one type of pin-lock end connector Next Generation Scaffold Services Inc. (Houston, Tex.) end connector 702 shown in FIG. 5, where the two engagement sections are protruding "teeth" 802 (functioning as the pins in a pin-lock system) designed to pass through openings 901 in a rosette 900), all of which are hereby incorporated by reference.

Figures 6A, 6B, 6C, 6D, 6E, 6F, 6G:
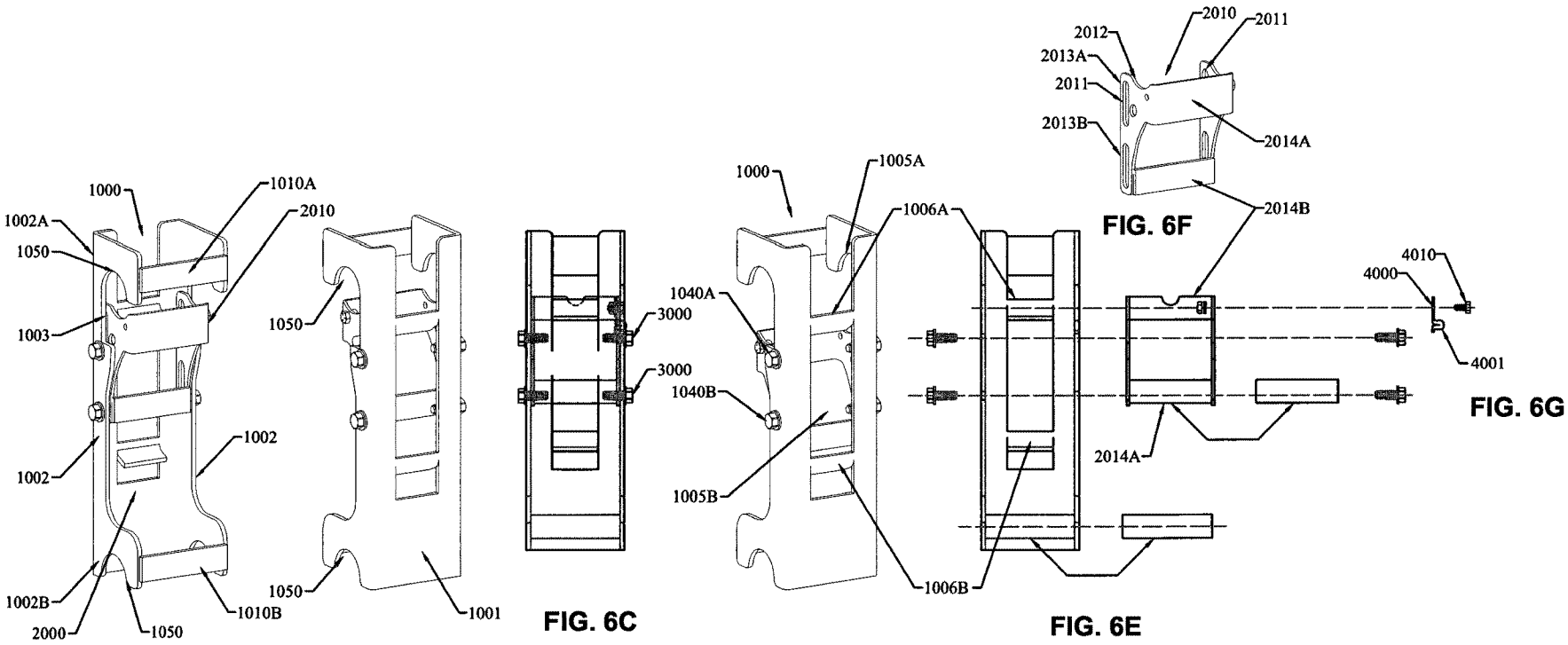
FIG. 6A is a front perspective view of one embodiment of the intermediate scaffold join (ISJ).
FIG. 6B is a rear perspective view of the ISJ of FIG. 6A.
FIG. 6C is a ghosted rear elevation view of the ISJ of FIG. 6A.
FIG. 6D is a rear perspective view of the frame of the ISJ of FIG. 6A.
FIG. 6E is a ghosted rear elevation view of the frame of FIG. 6D.
FIG. 6F depicts a front perspective view of the lock member of the ISJ of FIG. 6A.
FIG. 6G is a front elevation view of the lock member of FIG. 6F.
Figures 8A, 8B, 8C, 8D, 8E, 8F:
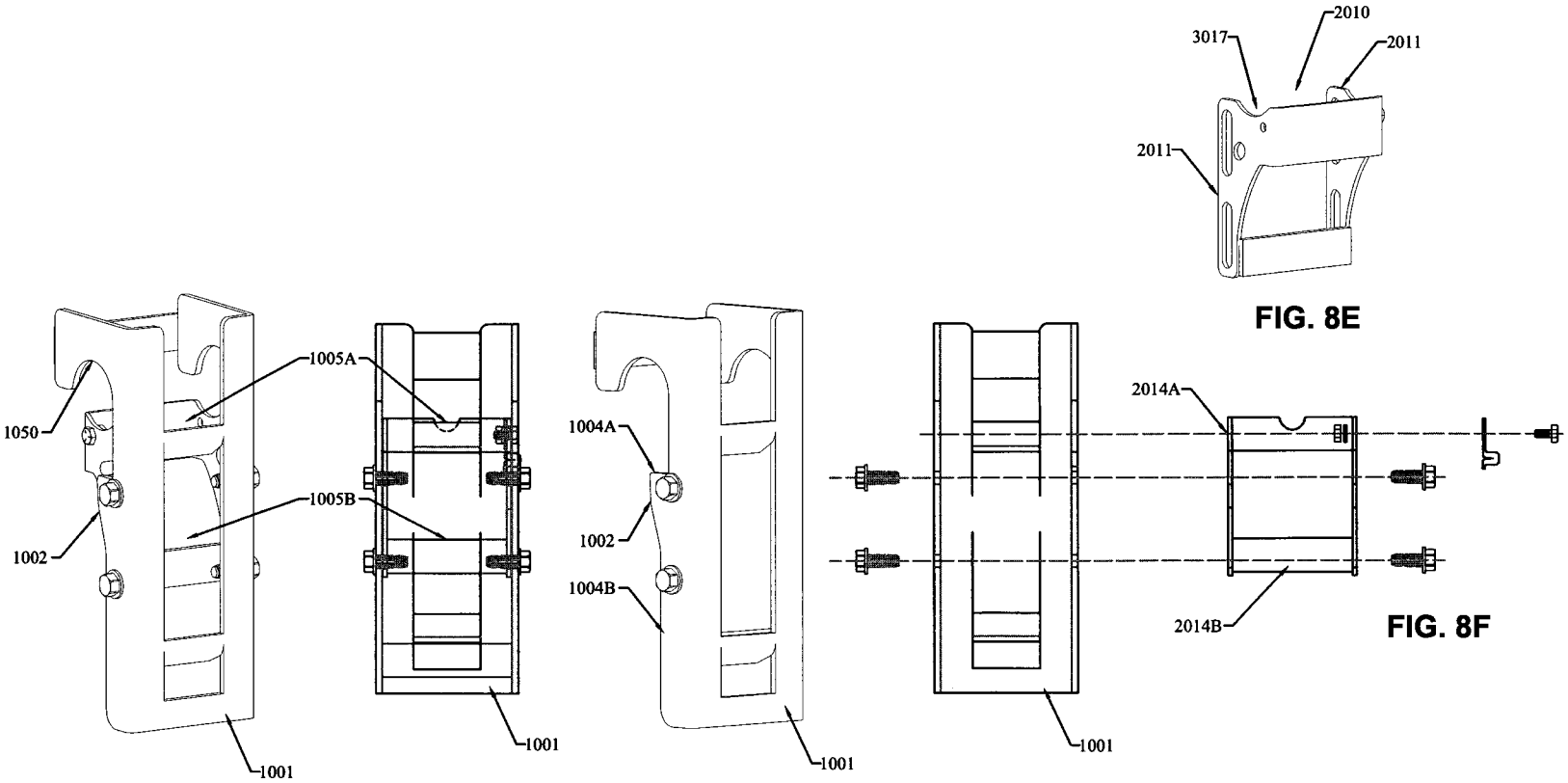
FIG. 8A is a rear perspective view of one embodiment of the intermediate scaffold join (ISJ).
FIG. 8B is a ghosted rear elevation view of the ISJ of FIG. 6A.
FIG. 8C is a rear perspective view of the frame of the ISJ of FIG. 8A.
FIG. 8D is a ghosted rear elevation view of the frame of FIG. 8C.
FIG. 8E depicts a front perspective view of the lock member of the ISJ of FIG. 6A.
FIG. 8F is a front ghosted elevation view of the lock member of FIG. 8E.
Figures 9A, 9B, 9C, 9D, 9E, 9F, 9G:
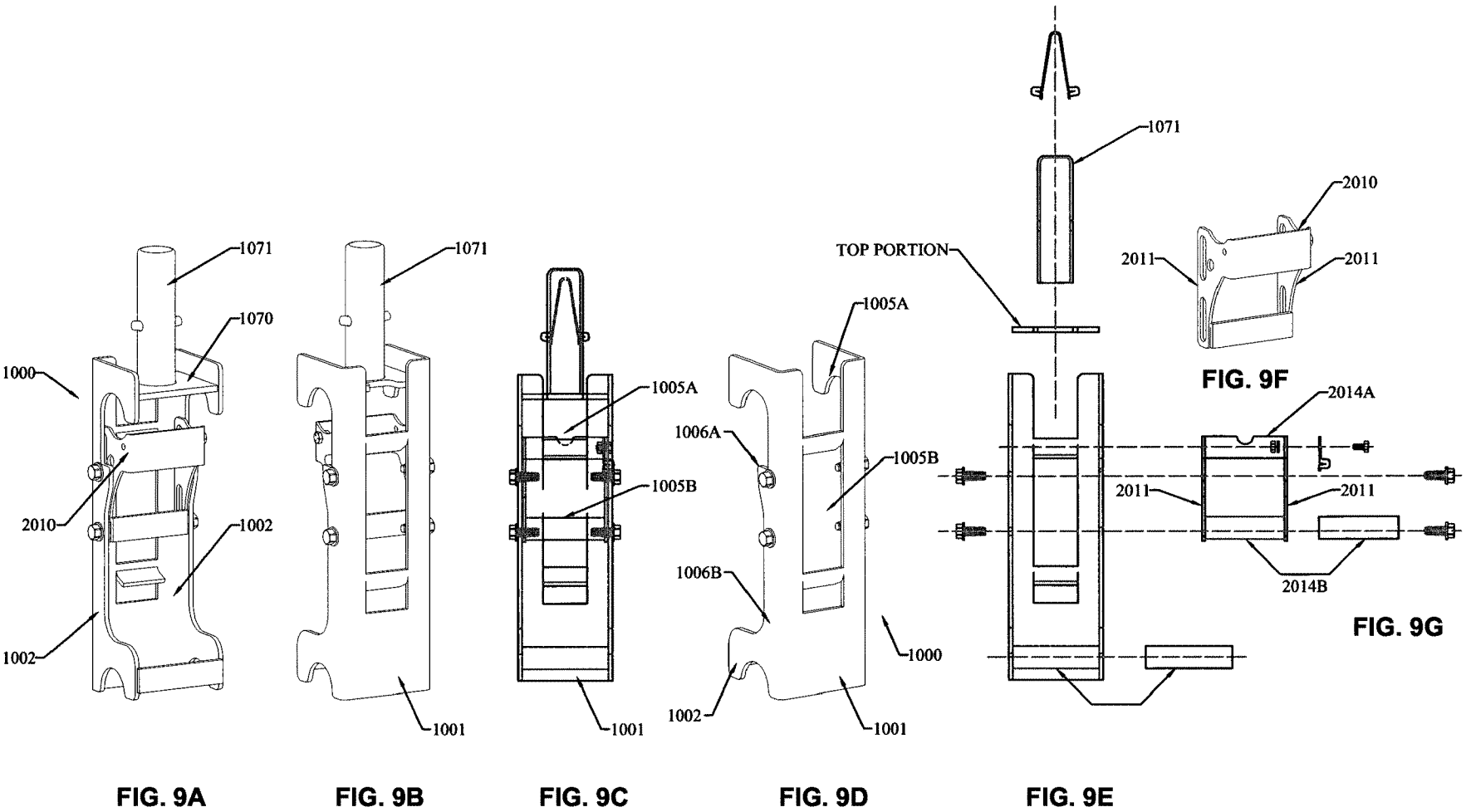
FIG. 9A is a rear perspective view of one embodiment of the intermediate scaffold joint (ISJ).
FIG. 9B is a front perspective view of one embodiment of the intermediate scaffold joint of FIG. 9A.
FIG. 9C is a ghosted rear elevation view of the ISJ of FIG. 9A.
FIG. 9D is a rear perspective view of the frame of the ISJ of FIG. 9A.
FIG. 9E is a ghosted rear elevation view of the frame of FIG. 9D.
FIG. 9F depicts a front perspective view of the lock member of the ISJ of FIG. 9A.
FIG. 9G is a front ghosted elevation view of the lock member of FIG. 9E.

One preferred embodiment of the new ISJ is shown in FIG. 6A-6F. As shown in FIG. 6D, the ISJ comprises a frame 1000, that has a rear plate portion 1001 and two similar side pieces 1002 (as shown, mirror image side pieces) extending forward from the rear plate portion 1001 at about 90 degrees. The two side pieces 1002 form an interior channel 2000 there between (see FIG. 6A). The top 1002A and bottom 1002B of each side piece 1002 extends further from the rear plate 1001 than other portions of the side pieces, and are shaped to form downwardly facing channel tabs 1050, here shown as arcuate shaped to match the horizontal member curvature to which it will couple. These channel tabs will engage or be supported (rest on) on two primary horizontal scaffold members (an upper and a lower, or a top and a bottom, primary horizontal scaffold members) vertically offset. The vertical offset can be substantial, for instance six feet. For strength and rigidity, the two opposing top channel tabs may be joined by a top front facing plate member 1010A, as can the two opposing bottom channel tabs with a bottom plate member 1010B (see FIG. 6A). Formed on at least one side piece, positioned between the top and bottom channel tabs 1002A and 1002B is an extending ledge portion 1003 (see FIGS. 6A and 6D). Each side piece 1002 is shown with two openings or slots 1004A and 1004B, through which bolts, screws or pins will be positioned (see FIGS. 6B and 6C). Preferably, the rear plate 1001 and side pieces 1002 are formed by stamping and bending a single piece of steel into the desired shape (See FIG. 7D).

The rear plate portion 1001, in one embodiment, preferably has two open portions or openings, a top open portion 1005A and a bottom open portion 1005B (FIG. 6D) vertically separated by a distance D, measured from the bottom or lower edges of these openings. Preferably, located below the bottom edge of each open portion 1005A and 1005B, are downwardly facing bendable tabs, 1006A and 1006B (FIGS. 6D and 6E). These tabs, in some embodiments, are bent inwardly into the interior channel 2000, as later described (for an Excel type end connector, FIG. 4). Alternatively, the lower edge of each opening 1005A, 1005B may form the bendable tabs. The two openings 1005A and 1005B are spaced apart to accommodate the two engagement portions 800 on a scaffold horizontal end connector, such as engagement sections 801 on an Excel or Safeway type end connector, or the teeth or pins on a pin lock type of connector (such as teeth 802 on the Next Generation Scaffold end connector of FIG. 5). That is, the vertical separation between the bottom lip or edge of each opening is a distance D which closely matches the vertical separation between the two engagement portions 800 on the horizontal scaffold member end connector that will coupled to the ISJ (coupled by mounting the engagement portions 800 of the horizontal members joint to the rear plate's two openings 1005A and 1005B).

The ISJ also includes a slidable lock member 2010, one embodiment of which is shown in FIG. 6F. The lock member 2010 shown has two similar side portions 2011 (shown as mirror images), horizontally spaced apart by the distance of the interior channel 2000 of frame 1000. Each side portion 2011 has an outwardly projecting top end 2012, and also has two vertically spaced apart through openings or grooves, top groove 2013A and bottom groove, 2013B (see FIG. 6F). The top and bottom of the opposing side portions 2011 may be preferably joined by tabs 2014A and 2014B for strength. As shown in FIG. 6G, the lock member 2010 is open on the rear side (the side facing rear plate 1001 of frame 1000, when installed in the frame 1000). The side portion's 2011 topmost edge 2012 may have an arcuate shaped region 3017, to couple to a horizontal scaffold member (see FIG. 7E). The lock member 2010 is slidably mounted on the frame (such as on the interior face of the side pieces 1002 of the frame (e.g., within the channel 2000 of the frame 1000) or on the exterior faces of the side pierced 1002) by bolts, rivets or pins 3000 that extend through the side openings 1004A and 1004B of side pieces 1002 of frame 1000, and then through the aligned grooves 2013A and 2013B in lock member 2010 side portions 2011 (alternatively, the groves may be on the lock member). Preferably, the side portions 2011 and top tab 2014A of the lock member are stamped and bent from a single piece of steel (see construction details in FIGS. 7A-7G).

In the embodiment shown, at least one side portion 2011 also has a button opening 2015 and a pin lock opening 2016 positioned in front of the top groove 2013A, (see FIG. 7E). The ISJ includes a latch to fix the position of the lock member 2010 with respect to the frame 1000. As shown I FIG. 6G, the latch is a spring snap button 4000 attached in the interior of the lock member 2010 by a bolt or pin 4010 through the pin lock opening 2016 on one side portion 2011 (see FIG. 6G). The button 4001 on the spring snap button 4001, is positioned to align with and extend through the button opening 2015 (see FIG. 7E). When the lock member 2010 is slidably positioned on the frame 1000 (see FIG. 6A-6C), the lock member 2010 is slidable from a locked position to an unlocked position (the lowermost position of the lock member 2010 with respect to the frame 1000).

Figure 11:
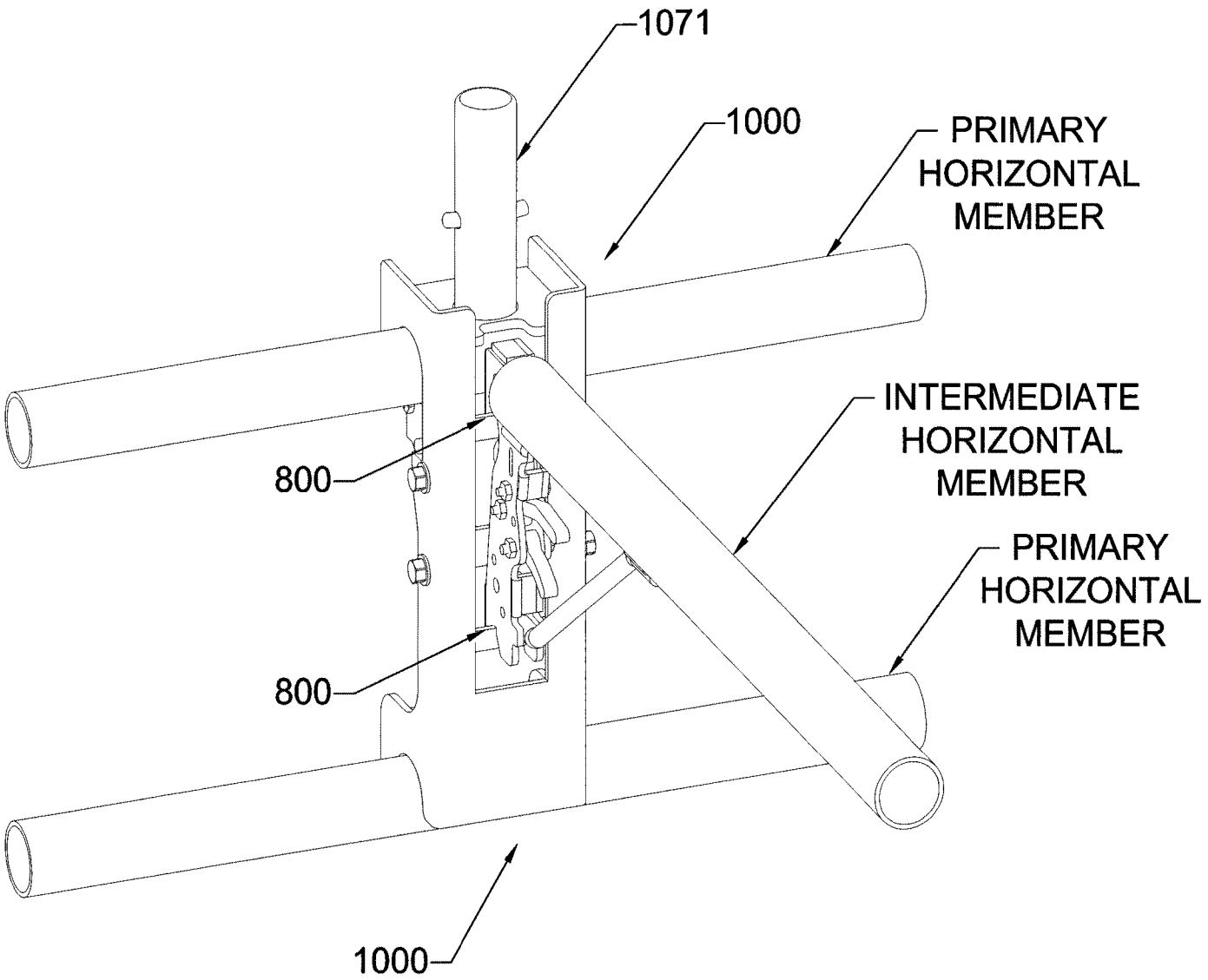
FIG. 11 is a rear prospective view of one embodiment of the ISJ of FIG. 9A installed.
Figure 15:
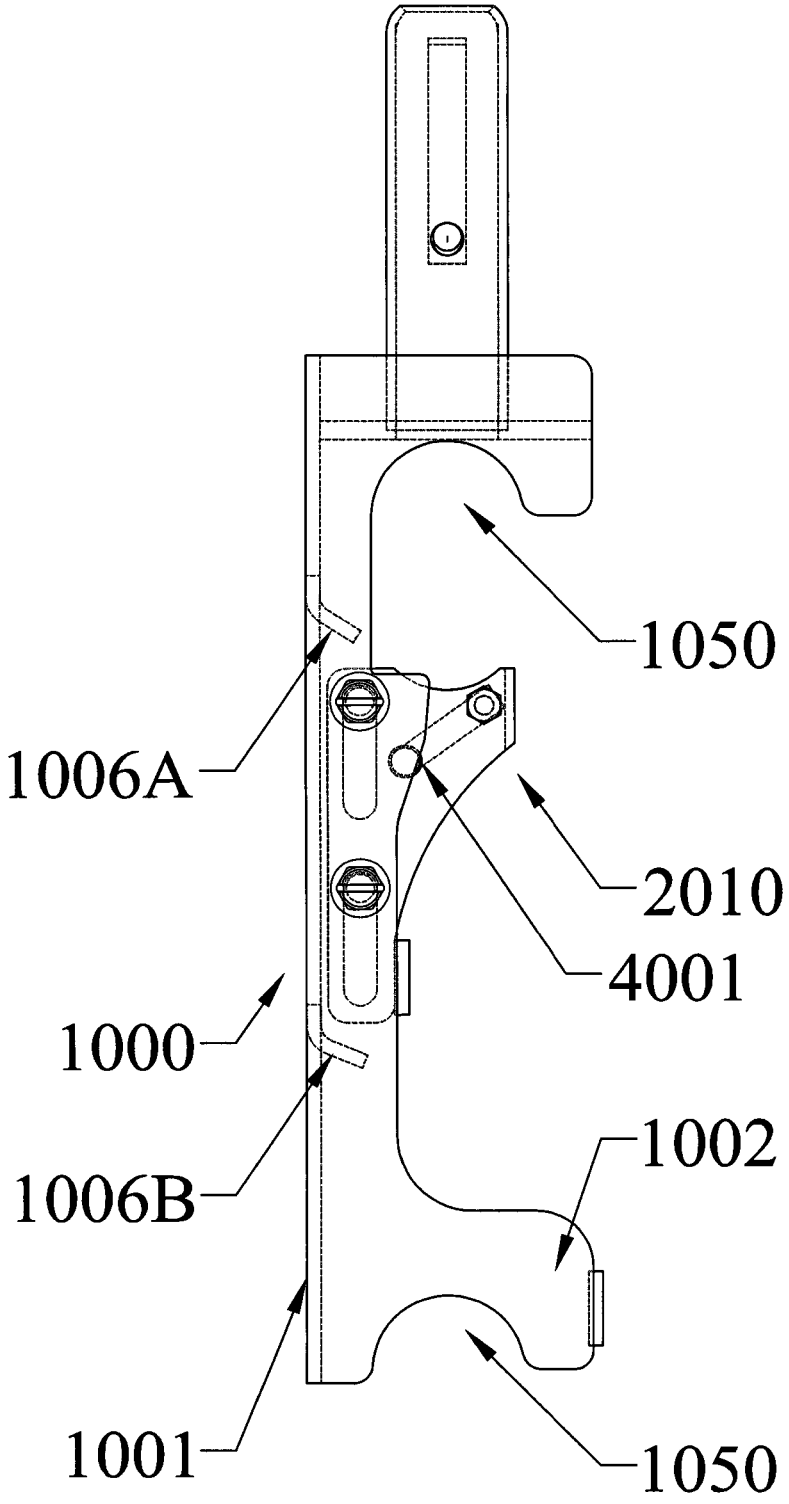
FIG. 15 is a side view of one embodiment of the ISA in a locked configuration.
Figure 16:
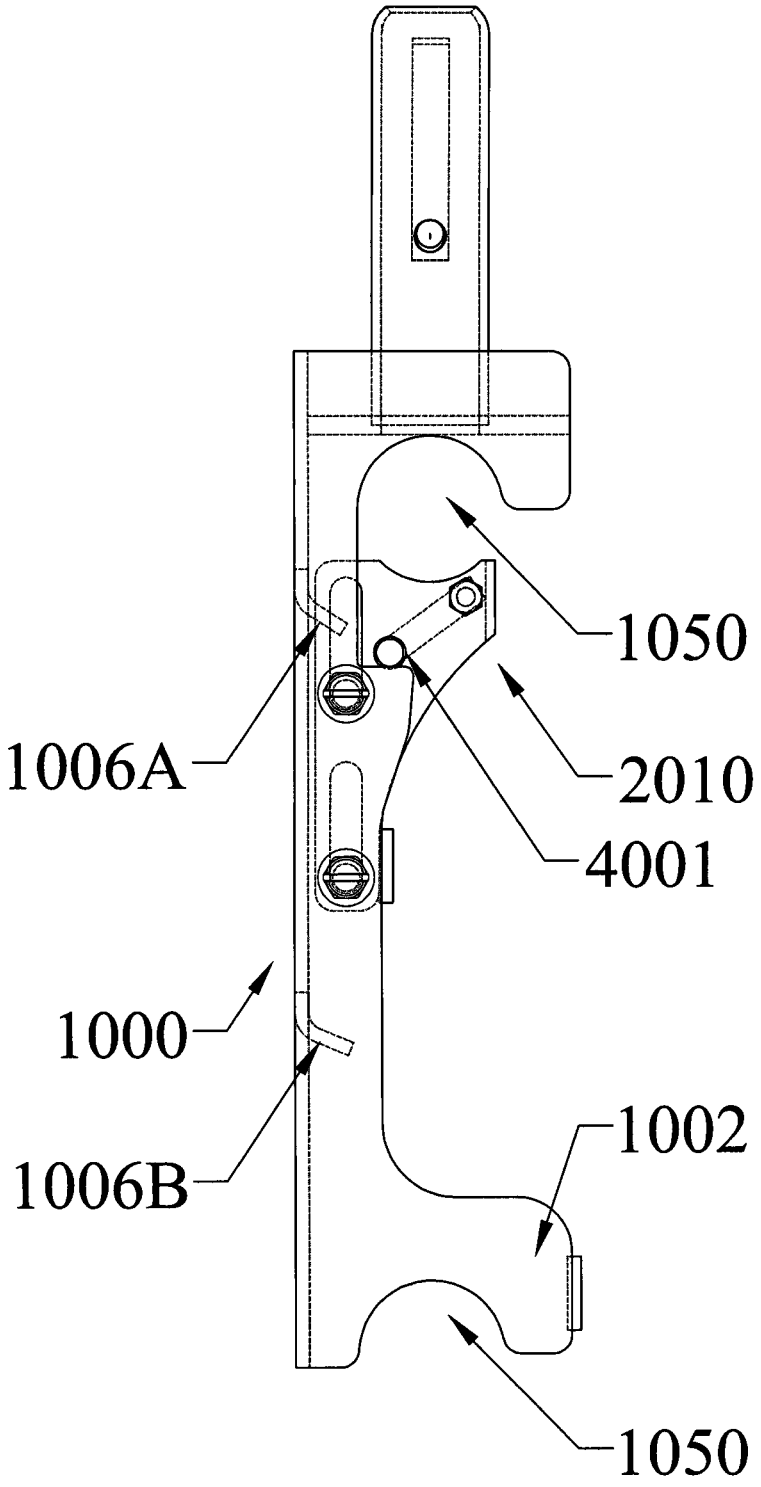
FIG. 16 is a side view of the embodiment of the ISA in FIG. 1 in an unlocked configuration.
Figure 17:
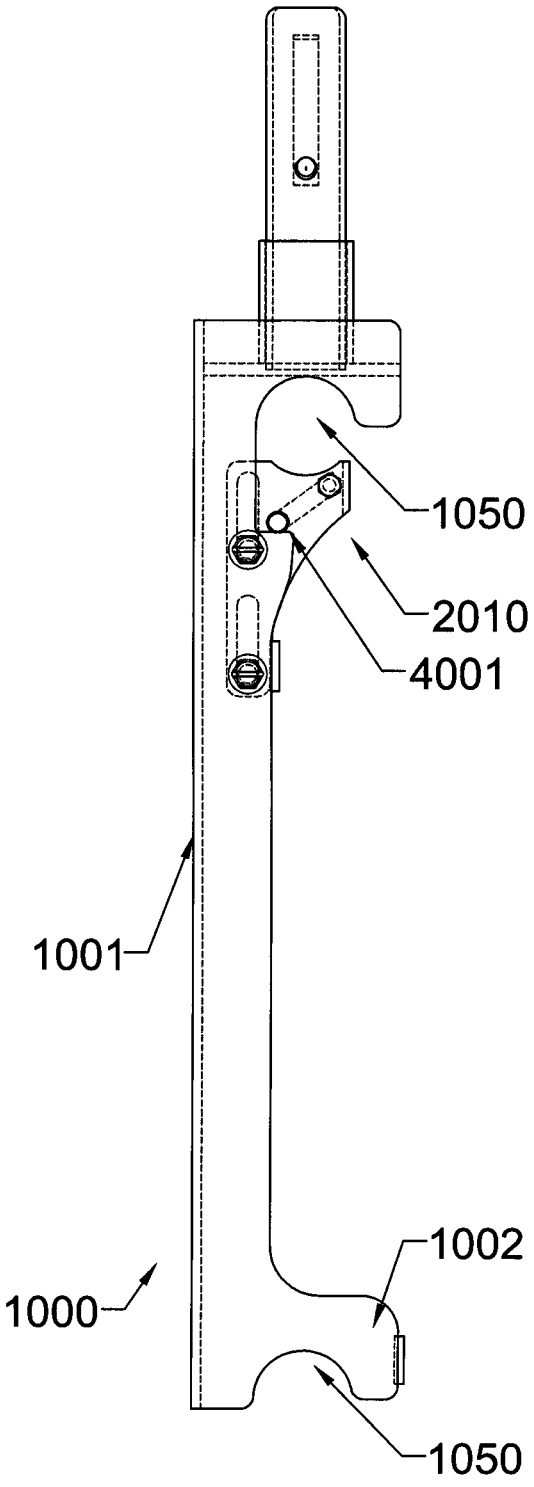
FIG. 17 is a side view of another embodiment of the ISA in a locked configuration.

In use, as the lock member 2010 is slid upwardly in the channel 2000 from its bottom most position (the unlocked or unlatched position), the button 4001 on the spring snap button 4000 is initially compressed (restrained) in the interior of the button opening 2015 by the adjacent side piece 1002 of the frame 1000 (see FIG. 15). As the lock member 2010 is slid further upwardly, the button 4001 will reach a position above the ledge member 1003 on the adjacent side piece 1002. In this position, the button 4001 springs outwardly through the button opening, catching on the edge of the ledge portion 1003 of the adjacent side piece 1002, preventing the lock member 2010 from sliding downwardly past the ledge 1003, thereby "locking" the lock member 2010 in place. When the button 4001 is positioned below the ledge portion 1003, the lock member is in an "unlocked position." In the locked position, the ledge portion 1003 of sidepiece 1002 acts as a 'stop' for button 4000, resisting downward motion of the lock member with respect to the frame 100 of the ISJ (instead of a ledge, the side piece 1003 may extend further upwardly and have an opening therethough to accommodate the button in a locked position). When in the locked position, the top of side portions 2011 of the lock member will act as a stop against a horizontal scaffold member positioned in the upper arcuate channel tabs 1050 of frame side portions 1002 (see FIG. 7A, FIG. 13, FIG. 16 and FIG. 17). That is, when the lock member 2010 is slid upwardly on the frame to the locked position, the top or the side portions 2011 of the lock member will be positioned adjacent the underside of a horizontal scaffold member that extends through the aligned arcuate shaped channel tabs 1050, thereby trapping the ISJ with respect to the horizontal scaffold member between the locking member 2010 and the channel tabs 1050 of frame 1000 (see FIG. 13), preventing removal of the ISJ from the horizontal scaffold members to which it is mounted. The ISJ will remained trapped until the spring button 4000 is pushed inwardly until it clears ledge portion 1003, allowing the slidable lock member 2010 to move downwardly with respect to the frame 1000 and allowing removal of the ISJ from the horizontal scaffold members. As described, this ISJ can be coupled to two primary parallel horizontal members 600 in an existing scaffold frame structure, a lower primary horizontal scaffold member positioned in lower channel tabs 1002B and an upper primary horizontal scaffold member positioned in upper channel tabs 1002A (see FIG. 11. If it is desired to couple to only a single horizontal member, the lower channel tabs 1002B may be eliminated, as depicted in FIGS. 8A-8F. Once coupled to the existing scaffold frame, another horizontal scaffold member may be joined to the ISJ at right angles to the coupled primary horizontal scaffold members, by mounting the new non-primary horizontal scaffold member (having a scaffold join with engagement portions 800) by coupling engagement portions 800 to the two offset openings 1005A and 1005B in the rear plate 101 of the frame 1000 of the ISJ.

Figure 10B:
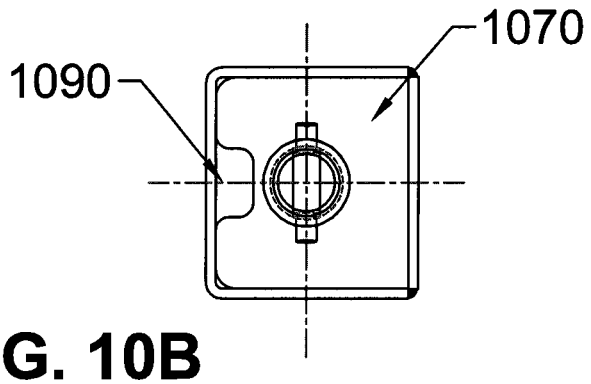
FIG. 10B is a ghosted top view of the ISJ of FIG. 9A.
Figure 10A:
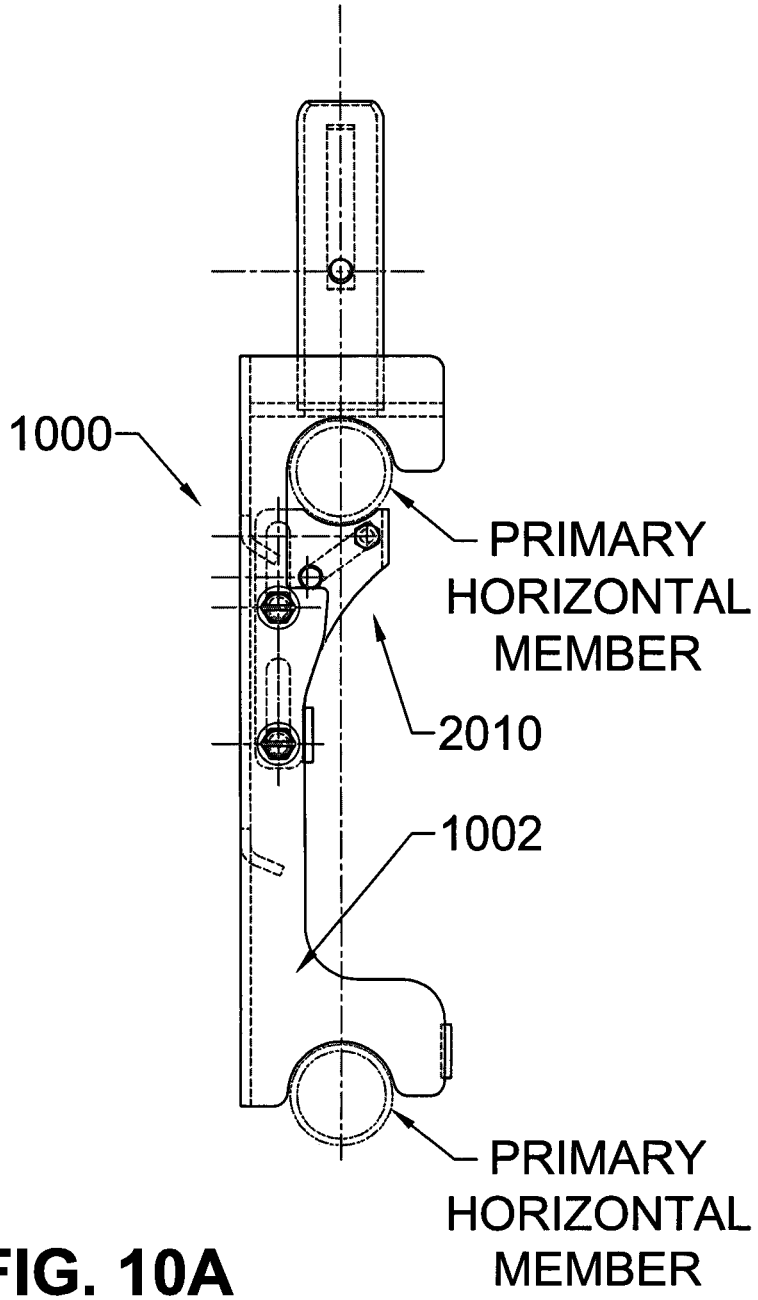
FIG. 10A is a ghosted side elevation view of the ISJ of FIG. 9A.

Another embodiment is shown in FIG. 9A-9F. This embodiment includes a top plate 1070, coupled or welded to the two side pieces 1002 of frame 1000, near the top end. Extending upwardly from this top plate 1070 is a stub member 1071. As shown, stub member 1071 is sized to fit inside (or in another embodiment, outside) a vertical scaffold member, allowing the placement of a new intermediate vertical scaffold member (between two existing vertical scaffold members) onto the top of the ISJ. In this fashion, a new "intermediate" vertical scaffold member can be located anywhere on a horizontal member, by joining an ISJ at the desired location of the intermediate member on the existing horizontal scaffold member. In the embodiment shown in FIGS. 10C and 10D, the top plate 1070 has a center cutout section 1090 on the interior side, to accommodate the attachment of a horizontal scaffold member to the rear plate 1001 of the ISJ, next described (see FIG. 11). In this fashion, an ISJ can be used to place either an intermediate horizontal or an intermediate vertical scaffold member (or both an intermediate horizontal and vertical scaffold member) in an existing scaffold frame.

Figure 12:
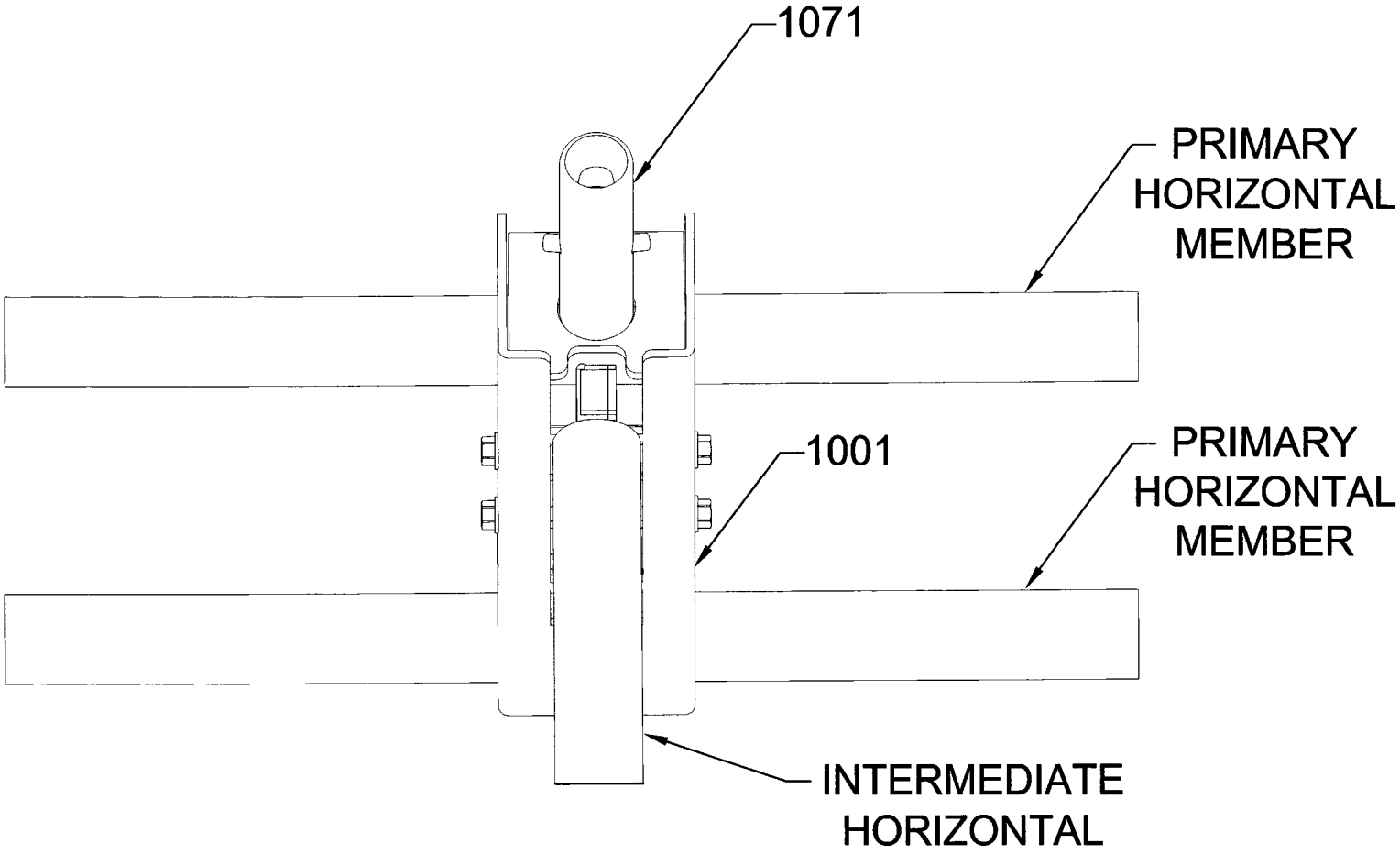
FIG. 12 is a top prospective view of the ISJ of FIG. 9A installed.

In operation, an ISJ 1000 can be utilized to attach an intermediate vertical scaffold member, as described above, or to join an intermediate horizontal scaffold member (or both intermediate horizontal and vertical scaffold members). To attach an intermediate horizontal member 600 to an ISJ, a user attaches the ISJ onto at least one pre-existing first primary horizontal scaffold member at a desired location between two opposing vertical scaffold members. An additional horizontal scaffold member will be joined as an "intermediate" horizontal scaffold member (e.g., between existing horizontals in the scaffold structure) on the scaffold frame. Preferably, the intermediate horizontal scaffold member to be joined to the ISJ terminates in an end connector or scaffold join, where the join preferably has two spaced apart engagement portions 800 separated by a distance D (the same distance separating the bottom edges or lips of openings 1005A and 1005B in the rear plate (for instance, joins as present in an Excel type or a Next Generation Scaffold horizontal scaffold members). The additional horizontal member 600 is positioned adjacent to the rear plate 1001 of the ISJ, at about 90 degrees (preferred) from the first primary horizontal scaffold member, with the engagement sections 800 of the additional horizontal scaffold member's join positioned above and adjacent to the two openings 1005A and 1005B on the rear plate 1001. The additional horizontal scaffold member is lowered until the engagement portions 800 are contacting and supported by the bottom edges of the openings 1005A and 1005B, such as shown in FIG. 12. Generally, the other end of the intermediate scaffold member (the distal end, not shown) is similarly coupled to a second ISJ, or to a pre-existing vertical scaffold member in the scaffold frame.

In one embodiment, the openings 1005A and 1005B in the rear plate are positioned so that the "topmost" portion of the added intermediate horizontal member is at the same height as the topmost portion of the top or upper primary horizontal scaffold member to which the ISJ is coupled. While this configuration is preferred, it is not necessary, for instance, the topmost portion of the intermediate horizontal member may be below the topmost portion of the primary horizontal scaffold members that are coupled to the ISJ.

Figure 13:
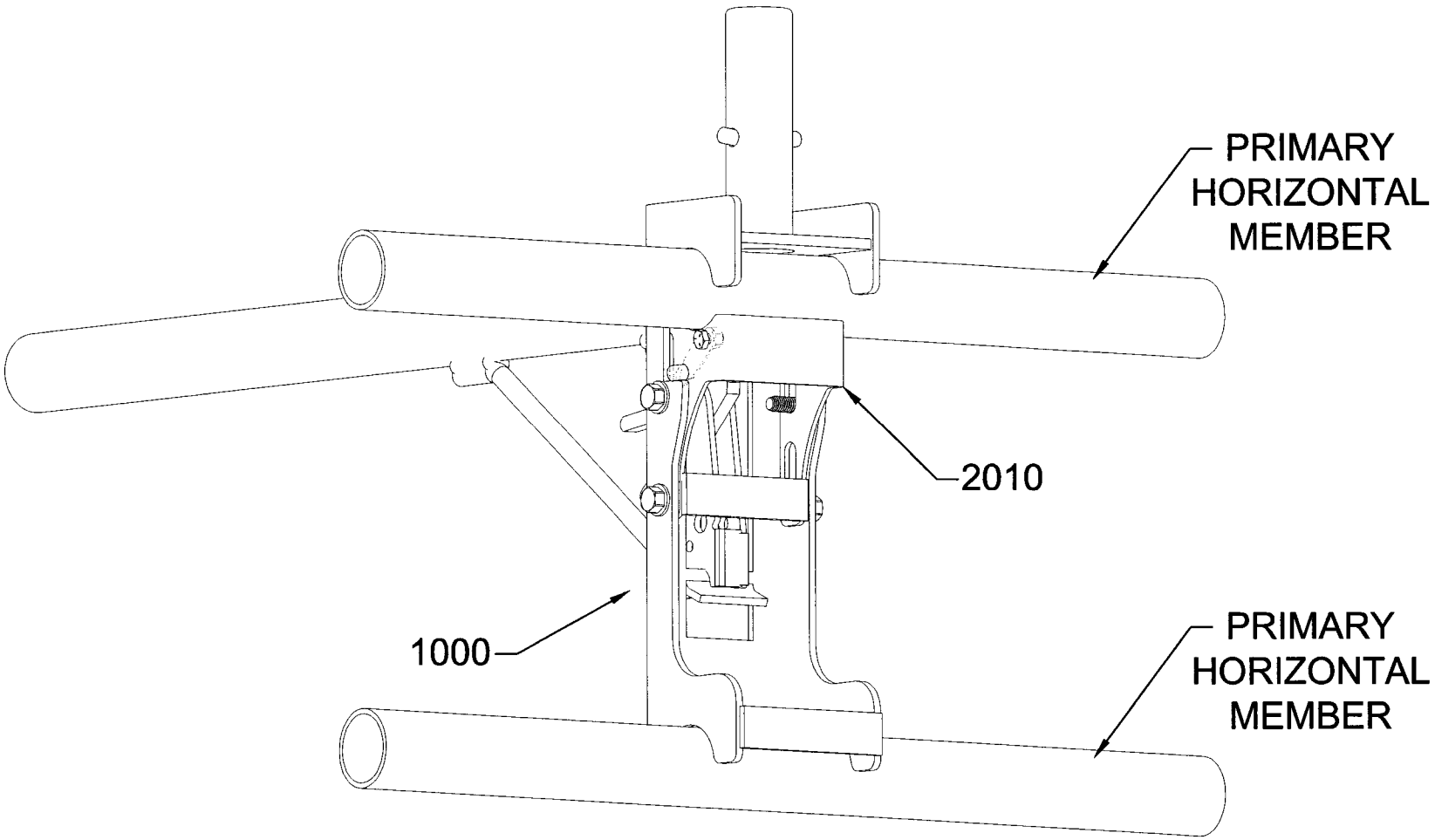
FIG. 13 is a front perspective view of the ISJ of FIG. 9A installed and locked.
Figure 14:
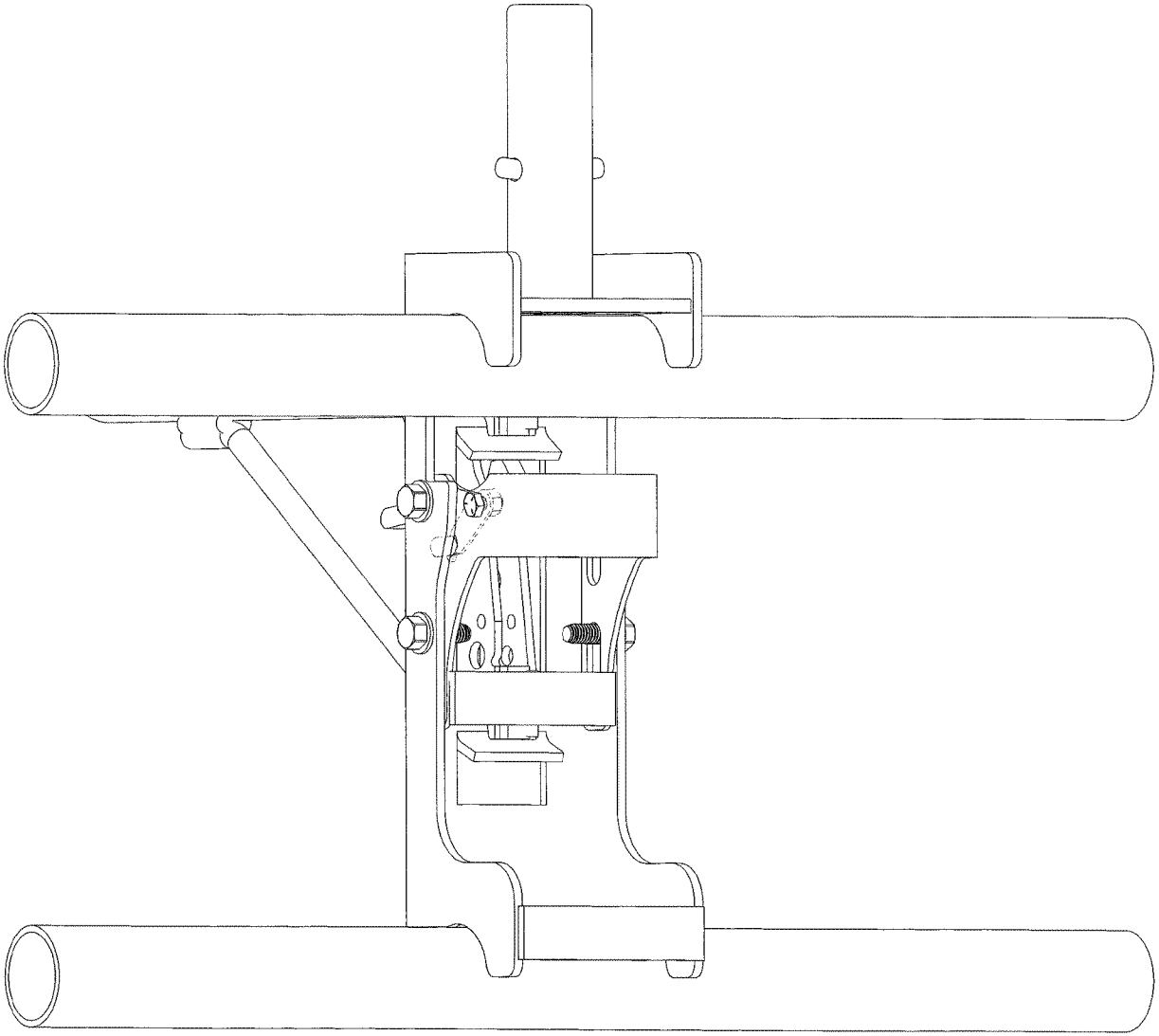
FIG. 14 is a front perspective view of the ISJ of FIG. 9A installed and unlocked.

The tab portions below the openings 1005A and 1005B, if bent into channel 2000, provide a "thicker" edge for the engagement portions 800 of the additional horizontal member to couple or to "grab" onto, for additional support, (the bent tabs more closely approximate an upstanding cup engagement used in an Excel or Safeway vertical scaffold member)(such as the Excel vertical shown in FIG. 13).

Many modifications and other embodiments of the inventions set forth herein will come to mind to one skilled in the art after having the benefit of the teaching presented in the foregoing descriptions and the associated drawings. For instance, in an alternative embodiment, the slidable latch member can be utilized but the mount member 1000 retains ½ cups on the rear plate (not preferred). Alternatively, the rear plate may be lacking both openings and cups, in which event, only an intermediate vertical member may be mounted to this ISJ. A joined intermediate horizontal member may include a moveable pivotable latch, such as disclosed in the Excel type connectors, or a slidable latch, such as disclosed in the Safeway type connectors. The pin lock connectors on some horizontal scaffold members may include either a pivotable latch or slidable latch (such as the Next Generation type of connectors). Instead of dual openings in the rear plate 1001, a single opening could be used to couple to an end connector on a horizontal member having only a single engagement section. Instead of the snap button interfacing a ledge on the side piece, the snap button may engage or "lock" opening on the side piece to lock the lock member to the frame of the ISJ. The snap button may be mounted on the side pieces of the frame 1000 and engage an opening in the lock member. Other lock types can also be utilized to maintain the lock member in the locked position, such as a pin inserted through the side pieces and side portions, or a latching bar (such as a pivoting bar). It should be understood that the invention disclosed herein is not to be limited to the specific embodiments disclosed and that modifications and other embodiments are intended to be included within the scope of the appended claims. Although specific terms may be employed herein, they are used in a generic and descriptive sense only and not for purposes of limitation.

What is claimed is:

1. An intermediate scaffold joint comprising:

a. a frame member comprising a rear plate portion having a top and bottom, and two side pieces, the side pieces extending forwardly from said rear plate portion, each side piece further comprising at least one downwardly facing channel tab, each channel tab shaped to engage a horizontal scaffold member; the rear plate portion and two side pieces defining a channel there between, said rear plate portion having two vertically spaced apart openings positioned through the rear plate portion, said rear plate portion lacking cups or ½ cups;

b. a lock member comprising two opposed side portions and further comprising a latch, said lock member's opposing side portions slidably mounted on said frame member's side pieces, and slidable from an unlocked position to a locked position, whereby in said locked position, said lock member latch engages one of said side pieces to thereby resist downward motion of said lock member from the locked position.

2. The intermediate scaffold joint of claim 1, wherein at least one of said side pieces has a ledge portion positioned between said two channel tabs, said ledge portion acting as a stop member for said latch.

3. The intermediate scaffold joint of claim 2 wherein one of said side pieces further has a movable button positioned thereon, and where said button rests on said ledge portion when said lock member is in the locked position.

4. The intermediate scaffold joint of claim 1 where said two openings are spaced apart a distance D, where said distance D corresponds to the distance between two spaced apart engagement sections on a horizontal scaffold joint positioned on an end of a horizontal scaffold member.

5. The intermediate scaffold joint of claim 4 wherein each opening in said rear plate portion has a bent tab located near a bottom edge of each of said openings, wherein said bent tab extends into the channel of said intermediate scaffold joint.

6. The intermediate scaffold joint of claim 1 wherein said side pieces have an exterior face and an interior face, and side portions being slidably mounted to the exterior face of said side pieces.

7. The intermediate scaffold joint of claim 1 wherein said side pieces have an exterior face and an interior face, and side portions being slidably mounted to the interior face of said side pieces.

8. The intermediate scaffold joint of claim 1 further has a top portion located above the channel tabs, and a tubular upstanding stub positioned on said top portion.

9. The intermediate scaffold joint of claim 1 wherein said each side piece further comprises two vertically separated downwardly facing channel tabs.

10. In a scaffold frame comprising vertical scaffold members connected to horizontal scaffold members, an intermediate scaffold joint comprising a. a frame member comprising a rear plate portion having a top and bottom, and two side pieces, the side pieces extending forwardly from said rear plate portion, each side piece further comprising two vertically offset downwardly facing channel tabs, each channel tab shaped to engage a horizontal scaffold member; the rear plate portion and two side pieces defining a channel there between, said rear plate portion having two vertically spaced apart openings positioned through the rear plate portion, said rear plate portion lacking cups or ½ cups;

b. a lock member comprising two opposed side portions and further comprising a latch, said lock member's opposing side portions slidably mounted on said frame member's side pieces and slidable from an unlocked position to a locked position, whereby in said locked position, said lock member latch engages one of said side pieces to thereby resist downward motion of said lock member from the locked position;

said intermediate scaffold joint mounted on at least one primary horizontal scaffold member and located between two vertical scaffold members of said scaffold frame, said lock member positioned in the locked position to resist removal of the intermediate scaffold joint from said primary horizontal member;

an intermediate horizontal scaffold member terminating in a scaffold connector joint that includes two vertically offset engagement portions adapted to engage a cup or rosette positioned on a vertical scaffold member, each of said intermediate horizontal scaffold member's two engagement portions coupled to a respective one of said two openings on said rear portion of said intermediate scaffold joint, said intermediate horizontal scaffold member mounted at about 90 degrees from said at least one primary horizontal scaffold member.

11. The intermediate scaffold joint in claim 10 wherein said each of said intermediate horizontal scaffold member's two engagement portions are adapted to engage a respective upstanding annular cup on a vertical scaffold member, and wherein each opening in said rear plate portion has a bent tab located near a bottom edge of each of said openings, wherein said bent tab extends into the channel of said intermediate scaffold joint.

12. The intermediate scaffold joint in claim 10 wherein said intermediate horizontal scaffold member's two engagement portions are adapted to engage rosettes on a vertical scaffold member.

13. The intermediate scaffold joint in claim 10 further having a top portion with an upstanding vertical stub mounted thereon; said scaffold frame further having an intermediate vertical scaffold member mounted to said vertical stub.

14. In the scaffold frame of claim 10, a second intermediate scaffold joint positioned on a second primary horizontal member, wherein said intermediate horizontal member is mounted between said first and said second intermediate scaffold joints.

15. In a scaffold frame comprising vertical scaffold members connected to horizontal scaffold members, a first intermediate scaffold joint comprising a. a frame member comprising a rear plate portion having a top and bottom, and two side pieces, the side pieces extending forwardly from said rear plate portion, each side piece further comprising two vertically offset downwardly facing channel tabs, each channel tab shaped to engage a horizontal scaffold member; the rear plate portion and two side pieces defining a channel there between, said rear plate portion having two vertically spaced apart openings positioned through the rear plate portion, said rear plate portion lacking cups or ½ cups, and a top portion having an upstanding vertical stub mounted thereon;

b. a lock member comprising two opposed side portions and further comprising a latch, said lock member's opposing side portions slidably mounted on said frame member's side pieces and slidable from an unlocked position to a locked position, whereby in said locked position, said lock member latch engages one of said side pieces to thereby resist downward motion of said lock member from the locked position;

said first intermediate scaffold joint mounted on at least one primary horizontal scaffold member and located between two vertical scaffold members of said scaffold frame, said lock member positioned in the locked position to resist removal of the first intermediate scaffold joint from said primary horizontal scaffold member;

an intermediate vertical scaffold member coupled to said upstanding vertical stub.

* * * * *